US006433742B1

(12) United States Patent
Crawford

(10) Patent No.: US 6,433,742 B1
(45) Date of Patent: Aug. 13, 2002

(54) DIVERSITY ANTENNA STRUCTURE FOR WIRELESS COMMUNICATIONS

(75) Inventor: James A. Crawford, San Diego, CA (US)

(73) Assignee: Magis Networks, Inc., San Diego, CA (US)

( * ) Notice: Subject to any disclaimer, the term of this patent is extended or adjusted under 35 U.S.C. 154(b) by 0 days.

(21) Appl. No.: 09/693,465

(22) Filed: Oct. 19, 2000

(51) Int. Cl.[7] ..... H01Q 1/38; H01Q 1/24
(52) U.S. Cl. ..... 343/700 MS; 343/702
(58) Field of Search ..... 343/700 MS, 702, 343/846, 848; H01Q 1/38, 1/24

(56) References Cited

U.S. PATENT DOCUMENTS

| | | | | | |
|---|---|---|---|---|---|
| 3,488,445 | A | | 1/1970 | Chang | 179/15 |
| 4,538,153 | A | | 8/1985 | Taga | 343/700 |
| 5,138,328 | A | | 8/1992 | Zibrik et al. | 343/702 |
| 5,146,232 | A | | 9/1992 | Nishikawa et al. | 343/713 |
| 5,282,222 | A | | 1/1994 | Fattouche et al. | 375/1 |
| 5,369,670 | A | | 11/1994 | Zagloul et al. | 375/84 |
| 5,402,136 | A | | 3/1995 | Goto et al. | 343/729 |
| 5,410,748 | A | | 4/1995 | Hayashi et al. | 455/277.1 |
| 5,420,599 | A | | 5/1995 | Erkocevic | 343/828 |
| 5,463,406 | A | | 10/1995 | Vannatta | 343/725 |
| 5,486,836 | A | | 1/1996 | Kuffner et al. | 343/700 |
| 5,487,069 | A | | 1/1996 | O'Sullivan et al. | 370/94.3 |
| 5,552,798 | A | * | 9/1996 | Dietrich et al. | 343/893 |
| 5,555,268 | A | | 9/1996 | Fattouche et al. | 375/206 |
| 5,650,788 | A | * | 7/1997 | Jha | 343/700 MS |
| 5,657,028 | A | | 8/1997 | Sanad | 343/700 |
| 5,680,144 | A | | 10/1997 | Sanad | 343/700 |
| 5,832,031 | A | | 11/1998 | Hammons, Jr. | |
| 5,832,044 | A | | 11/1998 | Sousa et al. | 375/347 |
| 5,867,131 | A | | 2/1999 | Camp, Jr. et al. | |
| 5,936,580 | A | | 8/1999 | Van Puijenbroek | |
| 5,943,020 | A | | 8/1999 | Liebendoerfer et al. | 343/702 |
| 5,990,838 | A | | 11/1999 | Burns et al. | 343/702 |
| 5,991,864 | A | | 11/1999 | Kinney et al. | |
| 5,995,062 | A | * | 11/1999 | Denney et al. | 343/853 |
| 6,008,774 | A | | 12/1999 | Wu | 343/828 |
| 6,031,503 | A | | 2/2000 | Preiss, II et al. | 343/770 |
| 6,043,790 | A | | 3/2000 | Derneryd et al. | 343/853 |
| 6,054,955 | A | | 4/2000 | Schlegel, Jr. et al. | 343/702 |
| 6,091,364 | A | * | 7/2000 | Murakami et al. | 343/700 MS |
| 6,104,349 | A | * | 8/2000 | Cohen | 343/702 |
| 6,115,762 | A | | 9/2000 | Bell et al. | |
| 6,160,514 | A | | 12/2000 | Judd | 343/700 |
| 6,181,284 | B1 | | 1/2001 | Madsen et al. | |
| 6,198,460 | B1 | * | 3/2001 | Brankovic | 343/879 |
| 6,222,503 | B1 | | 4/2001 | Gietema et al. | 343/890 |

* cited by examiner

*Primary Examiner*—Hoanganh Le
(74) *Attorney, Agent, or Firm*—Fitch, Even, Tabin & Flannery

(57) ABSTRACT

An antenna structure for small wireless communication devices includes multiple antenna elements to achieve diversity and uniform hemispherical coverage gain. Individual patch antennas are located on separate surfaces of a polyhedron or hemispherical dome structure. The antenna structure is well-suited for operation at high frequencies, including the 5 to 6 GHz band. The antenna elements and RF circuitry can be combined in a small integrated enclosure, and the structure is suited for use in a base station of a WLAN.

37 Claims, 8 Drawing Sheets

105% 1/4 Wave Antenna

110% 1/4 Wave Antenna

125% 1/4 Wave Antenna

110% 1/4 Wave Antenna
Inset Feed

125% 1/4 Wave Antenna
Inset Feed

DIVERSITY ANTENNA STRUCTURE FOR WIRELESS COMMUNICATIONS

BACKGROUND OF THE INVENTION

1. Field of the Invention

The present invention relates generally to antennas, and more specifically to small antenna structures possessing diversity characteristics.

2. Discussion of the Related Art

A multipath environment is created when radio frequency (RF) signals propagate over more than one path from the transmitter to the receiver. Alternate paths with different propagation times are created when the RF signal reflects from objects that are displaced from the direct path. The direct and alternate path signals sum at the receiver antenna to cause constructive and destructive interference, which have peaks and nulls. When the receiver antenna is positioned in a null, received signal strength drops and the communication channel is degraded or lost. The reflected signals may experience a change in polarization relative to the direct path signal. This multipath environment is typical of indoor and in-office wireless local area networks (WLAN).

An approach to addressing the multipath problem is to employ multiple receiver antenna elements in order to selectively receive a signal from more than one direction. This approach, known as "diversity", is achieved when receiving signals at different points in space or receiving signals with different polarization. Performance is further enhanced by isolating the separate antennas. Wireless communication link bit error rate (BER) performance is improved in a multipath environment if receive and/or transmit diversity is used.

Conventional antenna structures that employ diversity techniques tend to be expensive and physically large structures that utilize bulky connectors, such as coaxial cable connectors. Such antenna structures are not suitable for residential and office use where low-cost and small physical size are highly desirable characteristics. Thus, there is a need for an antenna structure capable of employing diversity techniques that overcomes these and other disadvantages.

SUMMARY OF THE INVENTION

The present invention advantageously addresses the needs above as well as other needs by providing a diversity antenna structure that includes a dome having a plurality of facets and a plurality of antenna elements. At least one facet has located thereon at least one antenna element.

In one embodiment, the invention can be characterized as an antenna structure that includes a dome having at least two non-coplanar facets, at least two antenna elements, and active circuitry attached to a first inner surface of the dome and coupled to the antenna elements. Each facet has located thereon one of the antenna elements.

In another embodiment, the invention can be characterized as a method of making an antenna structure. The method includes the steps of: forming a dome having a plurality of facets; mounting separate antenna elements on at least two of the facets; attaching active circuitry to a first inner surface of the dome; and coupling the active circuitry to the antenna elements.

In another embodiment, the invention can be characterized as a method of receiving a signal in a multi-path environment. The method includes the steps of: placing a dome having a plurality of facets in the multi-path environment; receiving the signal from a first direction in the multi-path environment with a first antenna element located on one of the facets of the dome; and receiving the signal from a second direction in the multi-path environment with a second antenna element located on another of the facets of the dome.

In another embodiment, the invention can be characterized as a method of transmitting a signal in a multi-path environment. The method includes the steps of: placing a dome having a plurality of facets in the multi-path environment; transmitting the signal along a first direction in the multi-path environment with a first antenna element located on one of the facets of the dome; and transmitting the signal along a second direction in the multi-path environment with a second antenna element located on another of the facets of the dome.

A better understanding of the features and advantages of the present invention will be obtained by reference to the following detailed description of the invention and accompanying drawings which set forth an illustrative embodiment in which the principles of the invention are utilized.

BRIEF DESCRIPTION OF THE DRAWINGS

The above and other aspects featured and advantages of the present invention will be more apparent from the following more particular description thereof presented in conjunction with the following drawings herein.

Corresponding reference characters indicate corresponding components throughout several views of the drawing.

DETAILED DESCRIPTION OF A PREFERRED EMBODIMENT

The following description is not to be taken in a limiting sense, but is made for the purpose of describing the general principles of the invention. The scope of the invention should be determined with reference to the claims.

Figure 1A:
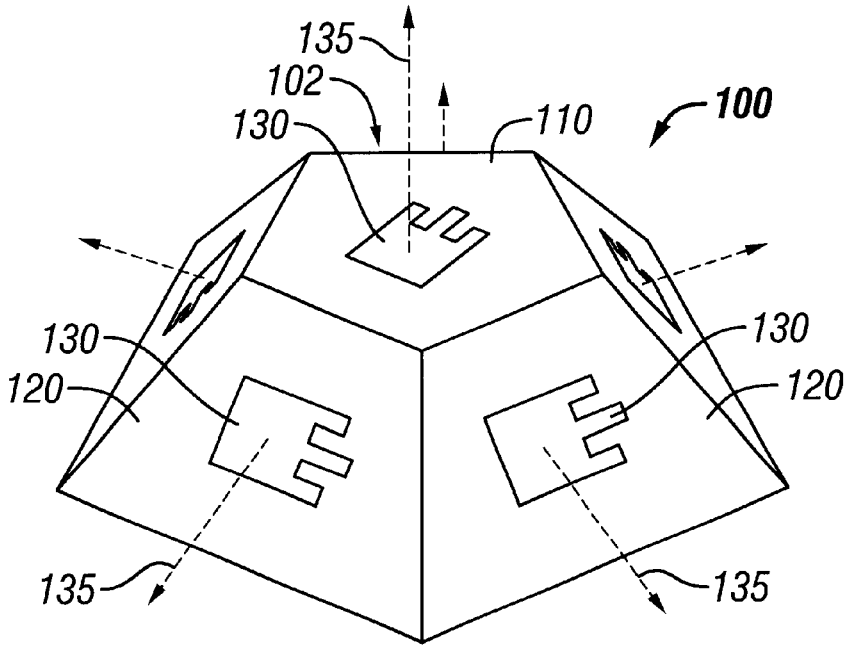
FIGS. 1A and 1B are perspective and top views, respectively, illustrating a multi-antenna element structure made in accordance with an embodiment of the present invention.
Figure 1B:
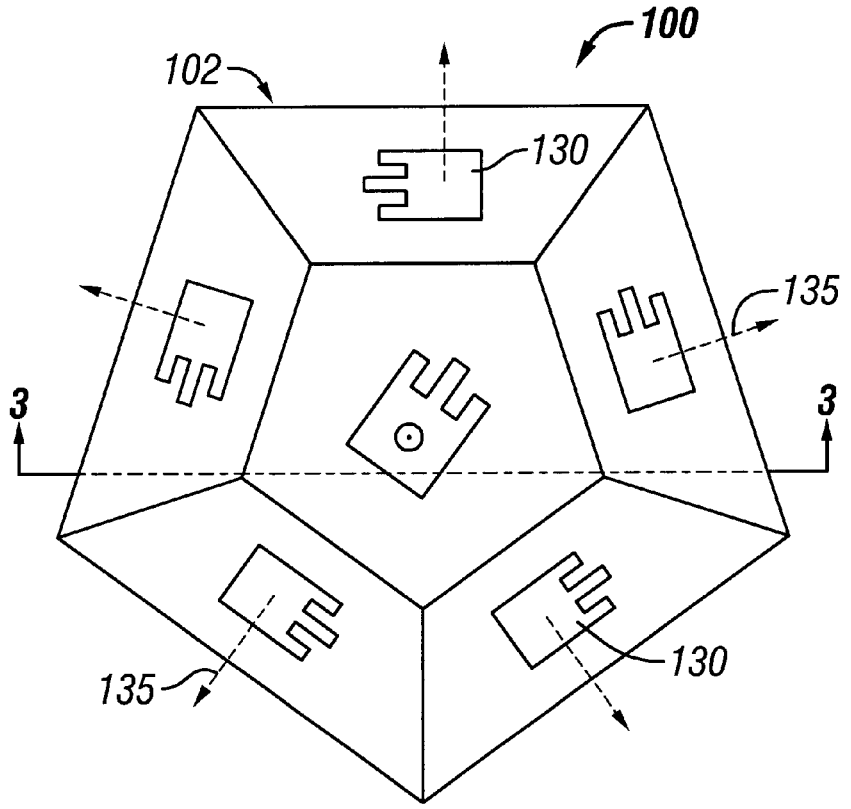

Referring to FIGS. 1A and 1B, there is illustrated a multi-antenna element structure 100 made in accordance with an embodiment of the present invention. The multi-antenna element structure 100 is ideal for use as a diversity antenna and overcomes the disadvantages described above. It can be manufactured for very low cost and is extremely well suited to small form-factor applications that are to be used at high frequencies, including the 5 to 6 GHz frequency band. The antennas, receiver, and transmitter circuitry can be combined in a small integrated enclosure.

For example, the multi-antenna element structure 100 is particularly suited for use in small base stations in wireless local area networks (WLAN). In a WLAN, the position of a device at the other end of a link is normally not known. The multi-antenna element structure 100 has good uniformity in signal strength in all directions, which makes it ideal for communicating with the numerous devices in a WLAN. In other words, the multi-antenna element structure 100 has uniform gain not in just one plane but over a hemispherical region.

The multi-antenna element structure 100 preferably comprises a dome structure 102. The dome structure 102 preferably takes the form of a polyhedron having two or more facets (or surfaces) 120. Each facet 120 preferably includes an antenna element 130. Arrows 135 show the primary axis of gain for each antenna element. The dome structure 102 can be easily constructed using metalized plastic or other substrate materials, or similarly low-cost construction techniques.

Each antenna element 130 provides gain while also having good isolation between itself and other antenna elements. The several separate antenna elements 130 achieve spatial and polarization diversity, which delivers good receive (or transmit) diversity performance. Again, the multi-antenna element structure 100 delivers very good uniform antenna gain over an entire hemisphere.

Figure 1C:
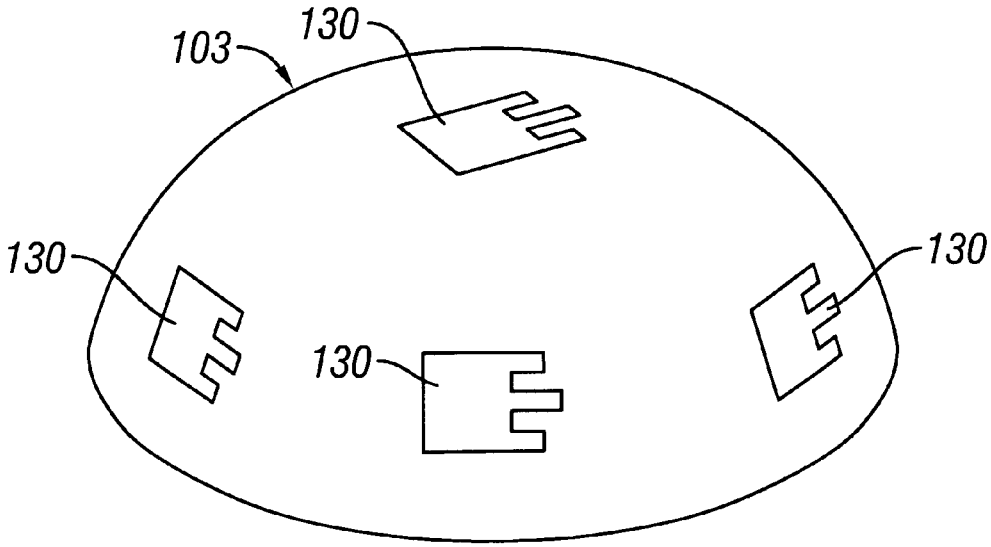
FIG. 1C is a perspective view illustrating an alternative multi-antenna element structure made in accordance with an embodiment of the present invention.

In other embodiments of the present invention the facets 120 do not have to explicitly be flat. For example, the facets 120 could instead be curvilinear/rounded. Referring to FIG. 1C, in this scenario the dome structure could take the form of a completely round hemisphere 103. Thus, it should be well understood that the dome structure of the present invention can have many different shapes and that the facets 120 do not have to be flat.

Figure 2:
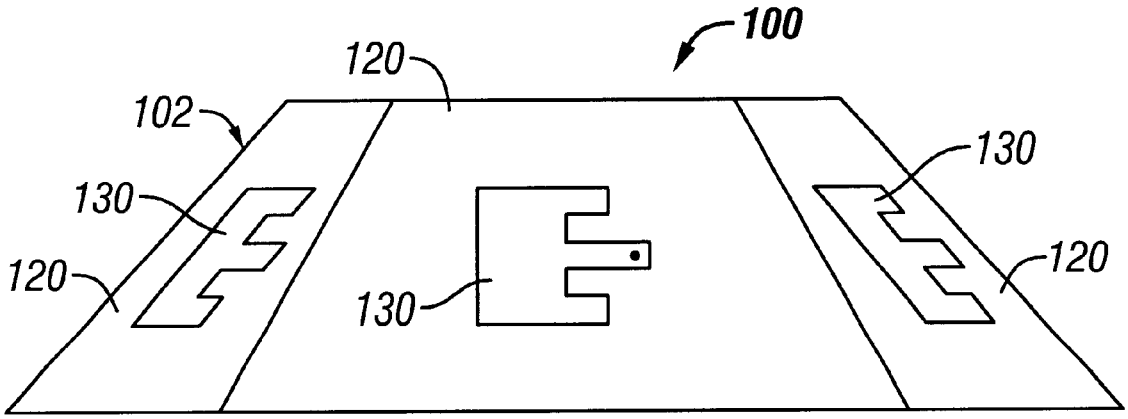
FIG. 2 is a side view illustrating an antenna element located on a single facet of the multi-antenna element structure shown in FIG. 1A.

Referring to FIG. 2, there is illustrated a detail of representative antenna element 130 located on facet 120. Again, each antenna element 130 is preferably positioned on the face or facet 120 of a polyhedron. In some embodiments, each facet 120 may contain more than one antenna element 130. Traditional patch antenna elements are a very cost-effective way to realize the individual antenna elements 130 for each facet 120. In a preferred embodiment, each antenna element 130 comprises a half-wave patch antenna. It should be well understood, however, that other types of patch antennas may be used, including ¼ wave and ¾ wave patch antennas. The detailed design process for an individual patch antenna is well-known in the industry. It should also be well understood that the antenna elements 130 can be comprised of multiple radiating elements or differing designs to provide different signal emphasis for different solid angle regions. Several representative patch antenna designs will be described below.

It was mentioned above that the polyhedron dome structure 102 includes two or more facets 120. Preferably, the polyhedron dome structure 102 includes six facets 120 and six antenna elements 130 to provide overlapping coverage of the complete hemisphere. It has been found herein that six facets is an optimum number. Specifically, in 3-dimensional space, there is a total of $4\pi$ steradians of solid angle. Assuming a uniformly illuminated aperture, the antenna gain for an aperture area $A_e$ is given by:

$$G_{ant} = \frac{4\pi A_e}{\lambda^2} \tag{1}$$

where $\lambda$ is the free-space wavelength. For an isotropic antenna, $G_{ant}=1$. The beam width of each antenna element determines the number of surfaces needed to provide full coverage over a hemispherical region. If it is assumed that each facet 120 has the same radiating aperture, and there are N facets involved (not counting the base), each facet should have a 3 dB beam width corresponding to $2\pi/N$ steradians. Using this reasoning and equation (1), a simplistic first-order estimate for the desired antenna aperture area is approximately:

$$A_e = \frac{N\lambda^2}{4\pi} \tag{2}$$

The 3 dB beam width for the microstrip half-wave patch antenna is approximately ±35 degrees. In terms of solid angle, this equates to:

$$\int_0^{\frac{\pi}{5}} d\theta \int_0^{2\pi} d\phi \sin(\theta) = 1.14 \text{ steradians} \tag{3}$$

which equates to approximately 0.18 of a hemisphere in terms of solid angle, somewhat less than ⅙th of the solid angle. If it is assumed that each facet-halfwave antenna covers ⅙*th of the hemisphere (overlapping at the* −3 dB beam width points), it is concluded herein that the polyhedron dome 102 should preferably contain six facets. This is a manageable number of diversity branches while also being large enough so as to provide potentially excellent diversity gain.

Figure 3:
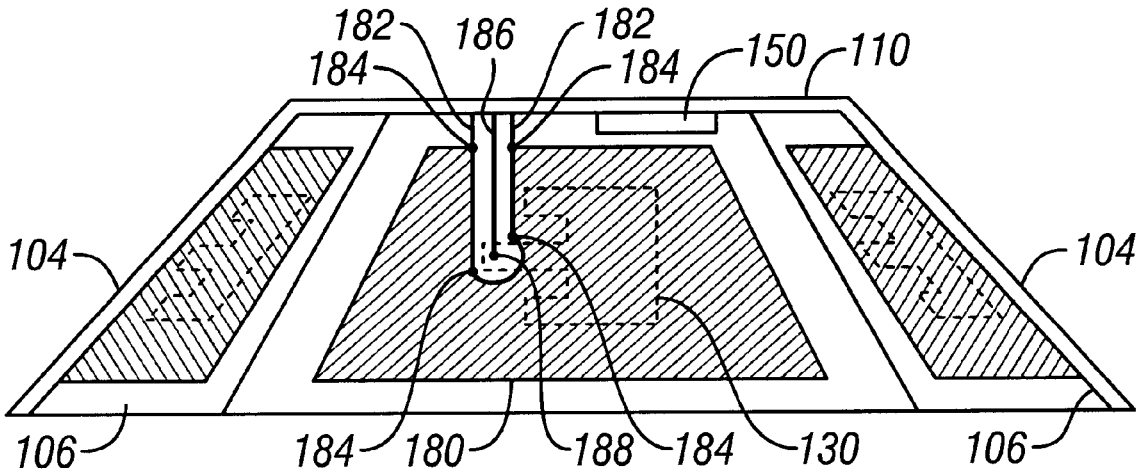
FIG. 3 is a cross-sectional view taken along line 3—3 in FIG. 1B illustrating the active circuitry on the inside of the multi-antenna element structure.

Referring to FIGS. 3 and 4some or all of the active circuitry 150 can be conveniently located on the underside of the top facet 110. Advantageously, this centralized location of the active circuitry 150 on the back-side of the top polyhedron facet 110 simplifies signal routing and eliminates the need for coaxial antenna connections. The active circuitry 150 may comprise power amplifiers for driving the antenna elements, low noise amplifiers (LNAs) for amplifying the received signals, RF switches for selecting signals routed to and from transmit and receive antenna elements, and/or digital baseband processing application specific integrated circuits (ASICs). The active circuitry 150 may also comprise additional circuitry that processes the transmitted and received signals, for example frequency translation from/to an intermediate frequency (IF) to/from the final radio frequency (RF) frequency.

The multi-antenna element structure 100 allows for a cost-effective means of routing both the transmit and receive signal paths to and from each antenna element 130. This is at least partly because the outer surface 104 includes metal patterns that define the structure of the patch antennas 130, and the inner surface 106 is metalized to provide a ground plane. Thus, microstrip or other transmission line methods may be used for routing transmit and receive signals.

Figure 5A:
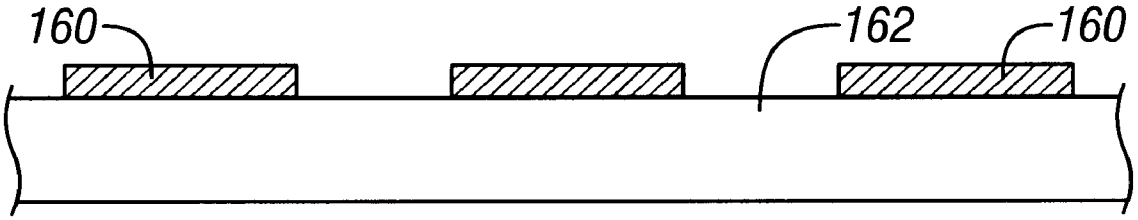
FIGS. 5A and 5B are cross-sectional diagrams illustrating exemplary transmission line techniques that may be used with the multi-antenna element structure shown in FIG. 1A.

Referring to FIG. 5A, by way of example, a coplanar feed structure can be used to connect antenna elements 130 to the active circuitry 150 for generating and receiving antenna signals. In the context of a metalized plastic (or other substrate material) realization for the antenna structure 100, a coplanar feed structure is very attractive because it is low-cost to implement. A coplanar feed does not use a ground plane. Instead, the signals are propagated using a pair of conductors 160 on the wall 162 of the dome 102 with controlled geometry to maintain substantially constant transmission line impedance. The conductors 160 may comprises copper or other metal, and as mentioned above the wall 162 may comprise plastic or other dielectric. In one embodiment, coplanar signal conductors are routed from each patch element 130 along the outer surface 104 of the polyhedron dome 102 toward the top facet 110. The conductors pass through the plastic structure to the inner surface 106 and connect to the active circuitry 150 located on the underside of the top facet 100. Alternatively, the signal conductors can be routed along the inner surface 106 to the active circuitry 150.

Figure 5B:
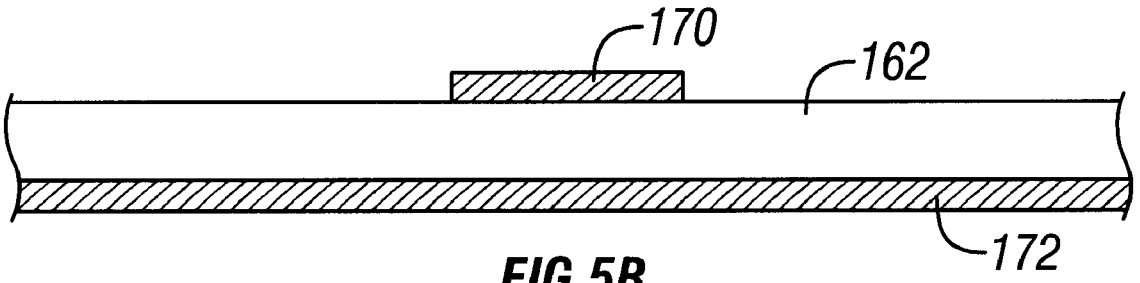
Figure 6A:
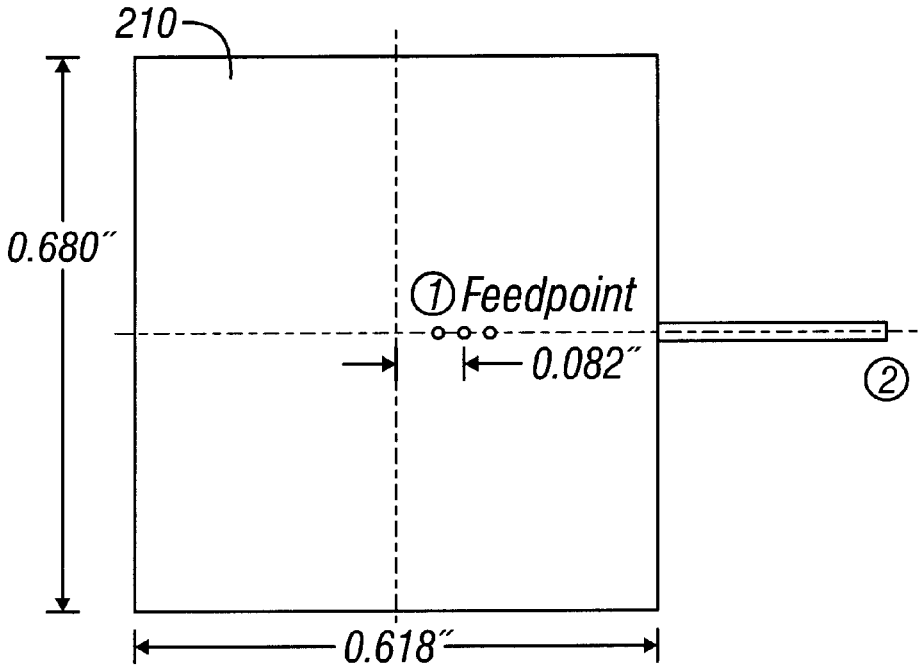
FIGS. 6A, 6B, 6C and 6D are schematic diagrams illustrating representative half-wave antenna elements suitable for use with the multi-antenna element structure shown in FIG. 1A.
Figure 6B:
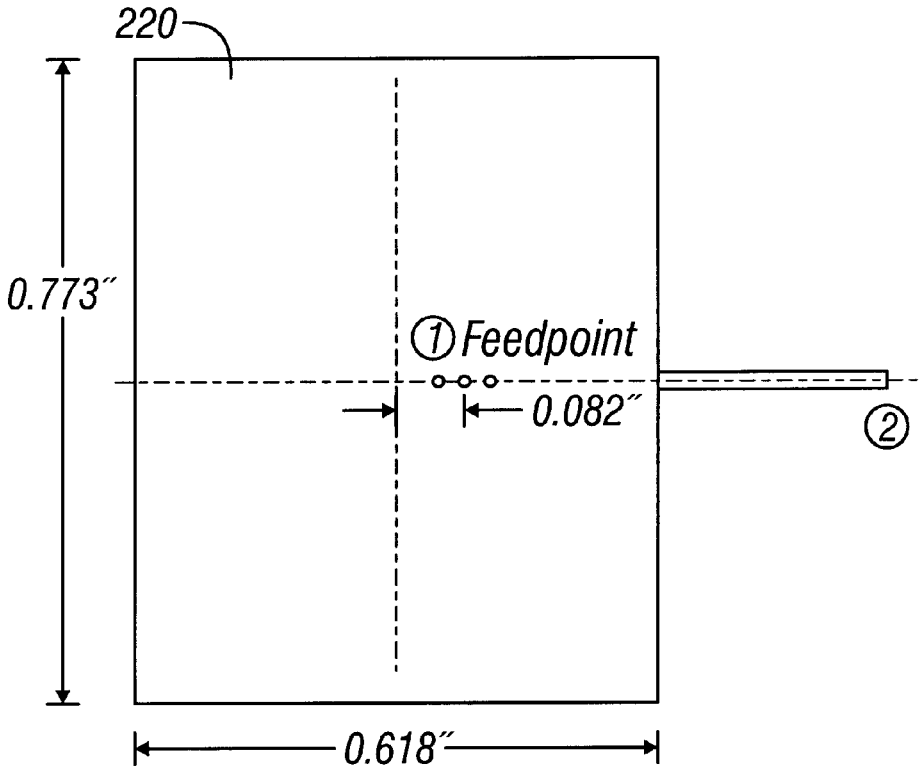
Figure 6C:
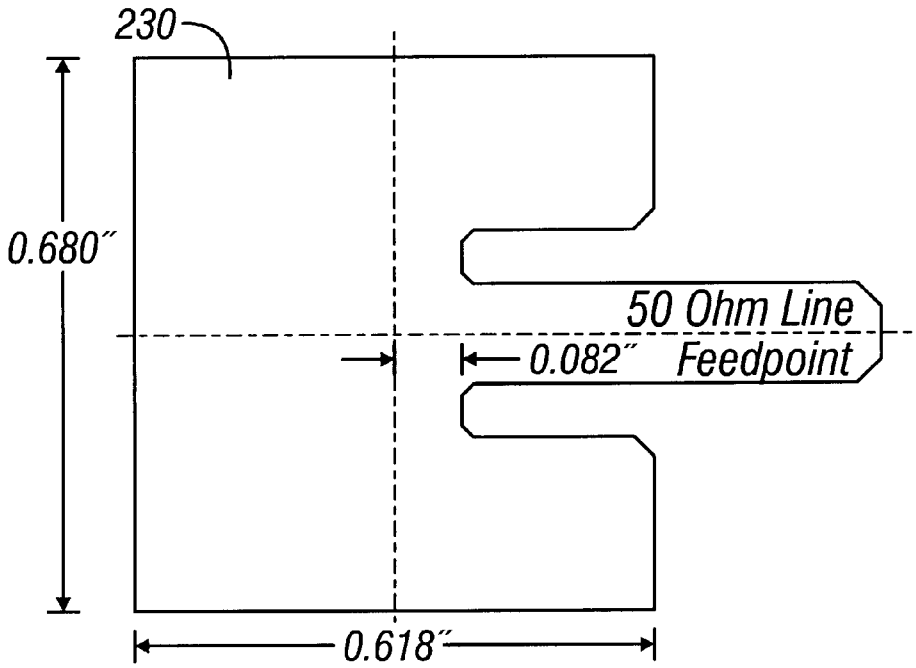
Figure 6D:
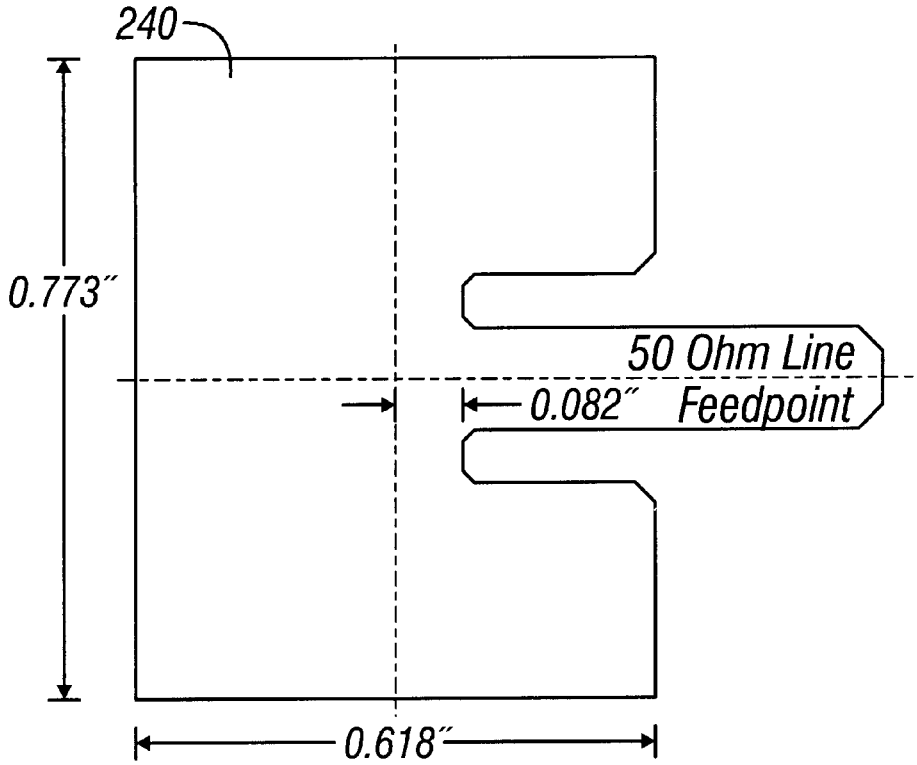
Figure 7A:
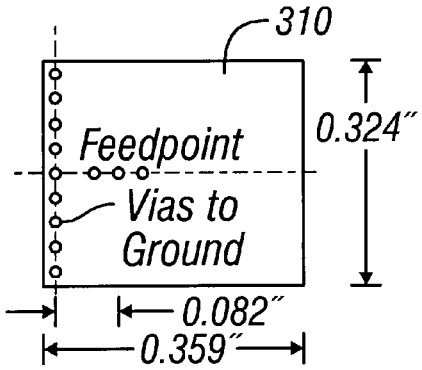
FIGS. 7A, 7B, 7C, 7D and 7E are schematic diagrams illustrating representative quarter-wave antenna elements suitable for use with the multi-antenna element structure shown in FIG. 1A.
Figure 7B:
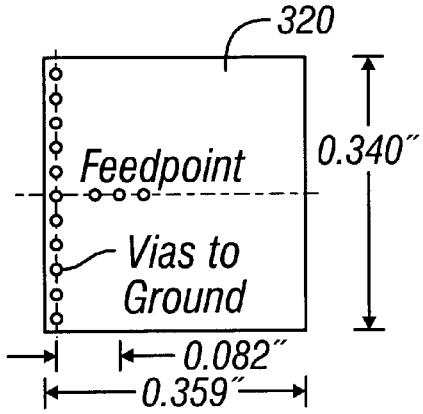
Figure 7C:
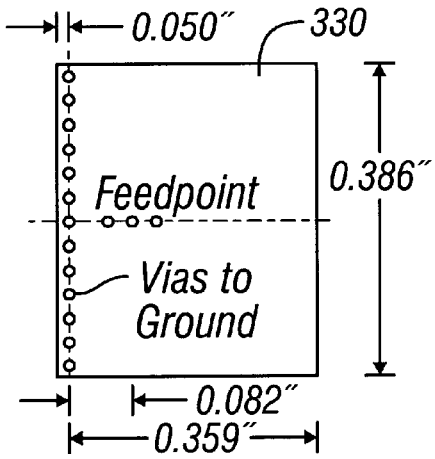
Figure 7D:
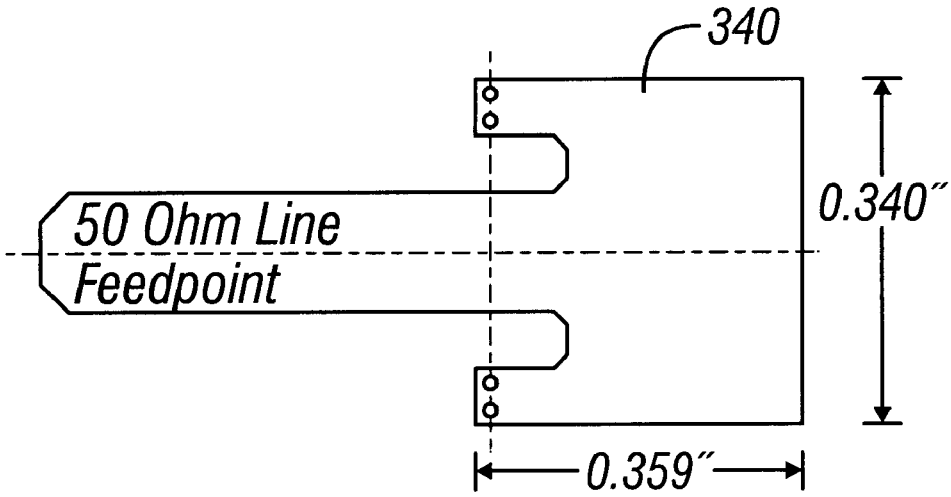
Figure 7E:
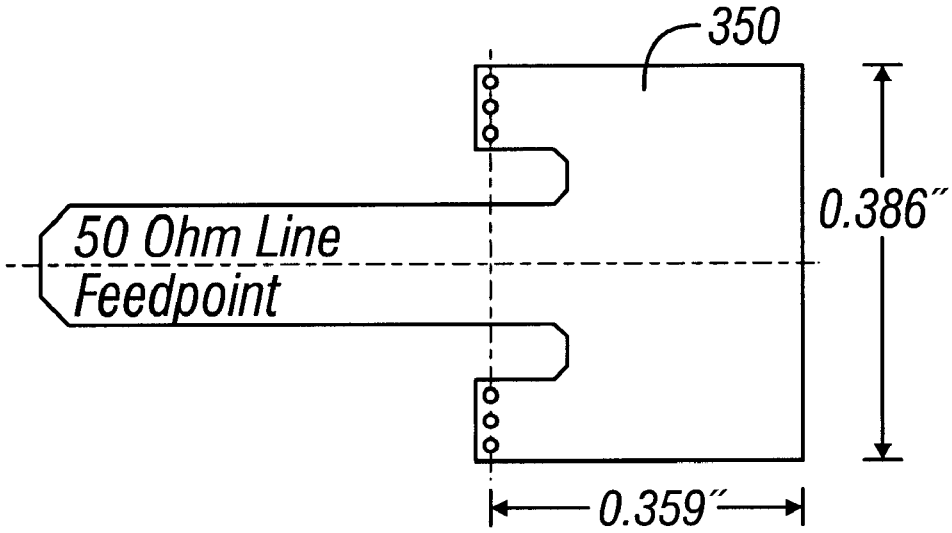

Referring to FIG. 5B, in an alternative embodiment, the feed structure can use microstrip techniques. A microstrip feed uses a single conductor 170 with a ground plane 172. The single conductor 170 is located on one side of the wall 162, and the ground plane 172 is located on the other side of the wall 162. The single conductor 170 and the ground plane 172 may comprise copper or other metal.

Figure 4:
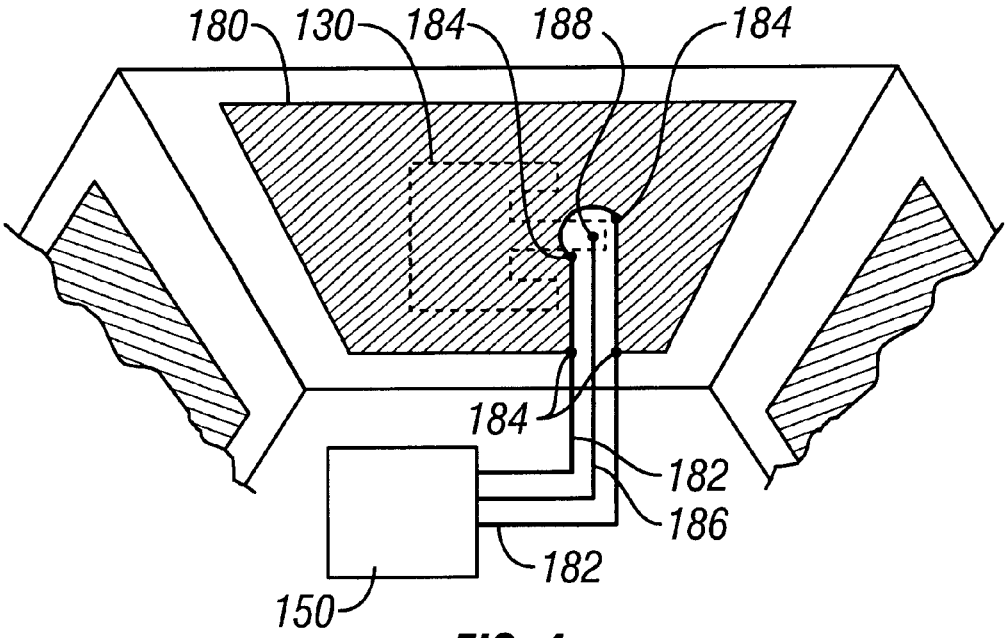
FIG. 4 is a partial bottom view further illustrating the active circuitry on the inside of the multi-antenna element structure shown in FIG. 1A and connections to same.

By way of example, FIGS. 3 and 4 illustrate one scenario where a coplanar feed structure is used to connect an antenna element 130 to the active circuitry 150 by routing the signal conductors along the inner surface 106. Specifically, a ground plane 180 is located on the inside surface of the housing. By way of example, the ground plane 180 may comprise copper plating. The ground paths 182 may be connected to the ground plane 180 with via connections 184. The center conductor 186 may be connected to the top-side microstrip of the antenna element 130 with a via connection 188 and the appropriate coplanar-to-microstrip impedance transition. The ground paths 182 and the center conductor 186 may be routed along the inside wall and the back-side of the top polyhedron facet 110 to the active circuitry 150. It should be well understood that this is just one exemplary manner of coupling the antenna elements 130 to the active circuitry 150 and that many other types of connections may be used in accordance with the present invention.

Referring to FIGS. 6A, 6B, 6C and 6D, there is illustrated several representative half-wave patch antenna designs. The illustrated designs are for operation centered at 5.25 GHz, but it should be well understood that operation in this frequency band is not a requirement of the present invention. Antenna 210 is a design with a 110% ratio of vertical to horizontal dimension that has a feed point from a ground plane layer beneath the patch. Antenna 220 is a 125% half-wave design with ground plane feed. Antenna 230 is 110% half-wave design with an inset feed. Antenna 240 is a 125% half-wave design with an inset feed. By way of example, all of these antenna designs can be fabricated using Rogers 4003 material of 0.060 thickness with double-sided ½ or 1 ounce tinned copper clad.

In an alternative embodiment, the antenna elements 130 can be ¼ wave microstrip antennas or other wavelength ratios. Referring to FIGS. 7A, 7B, 7C, 7D and 7E, there is illustrated several representative quarter-wave patch antenna designs. The illustrated designs are for operation centered at 5.25 GHz, but again it should be well understood that operation in this frequency band is not required. Antenna 310 is a design with a 105% ratio of vertical to horizontal dimension that has a feed point from a ground plane layer beneath the patch. Antenna 320 is a 110% quarter-wave design with ground plane feed. Antenna 330 is a 125% quarter-wave design with ground plane feed. Antenna 340 is 110% quarter-wave design with an inset feed. Antenna 350 is a 125% quarter-wave design with an inset feed.

In general, patch antenna elements can be fabricated according to a microstrip technique, where etched copper patterns lie above a ground plane. Microstrip antennas are discussed generally in CAD of *Microstrip Antennas for Wireless Applications*, Artech House Antenna and Propagation Library, by Robert A. Sainati, 1996; *Advances in Microstrip and Printed Antennas* by Kai Fong Lee and Wei Chen, 1997; and *Microstrip Antennas: The Analysis and Design of Microstrip Antennas and Arrays* by David Pozar and Daniel Schaubert, 1995, each incorporated herein by reference.

The multi-antenna element structure 100 is capable of achieving diversity. Specifically, when receiving a signal in a multi-path environment, the signal is received from one direction with one antenna element, another direction with another antenna element, etc. Similarly, when transmitting a signal in a multi-path environment, the signal is transmitted along one direction with one antenna element, along another direction with another antenna element, etc.

The multi-antenna element structure 100 can be easily manufactured. Specifically, a polyhedron dome is formed that includes at least two facets and preferably six facets. Separate antenna elements are mounted on at least two of the facets, preferably all six facets. Active circuitry is attached to the inner surface of the polyhedron dome, preferably the upper surface. The active circuitry is coupled to the antenna elements, preferably by using a coplanar feed structure or microstrip techniques.

Thus, the multi-antenna element structure 100 is a low-cost three-dimensional antenna structure which can deliver fairly uniform gain over an entire hemisphere while also providing diversity gain. It provides a high number of independent antenna elements per unit volume, and its unique geometric orientation provides a high number of beams per unit volume. In one embodiment, the use of the polyhedron structure is based upon using the same half-wave patch antenna design for each facet of the polyhedron, tying together a relationship between the 3 dB beam width of the individual patch antennas with the number of polyhedron facets utilized. The design can be implemented using low-cost metalized plastic. The centralized and convenient location of the RF IC on the back-side of the top polyhedron facet simplifies signal routing and eliminates the need for any coaxial antenna connections. Advantageously, the low-cost interconnections afforded by microstrip, coplanar connection, or the like, may be used. Arbitrary patch antenna designs could be used for each facet if desired, or more emphasis can be placed for different solid angle regions if desired.

While the invention herein disclosed has been described by the specific embodiments and applications thereof, numerous modifications and variations could be made thereto by those skilled in the art without departing from the scope of the invention set forth in the claims.

What is claimed is:

1. A diversity antenna structure comprising:

a dome having a plurality of positionally non-adjustable facets; and at least two but not more than six antenna elements attached to the dome with the antenna elements being arranged and configured so that the antenna elements together provide substantially full coverage over a hemispherical region;

wherein at least one facet has located thereon at least one antenna element;

wherein the antenna elements are configured to achieve diversity in a local area multipath environment that is created when a signal reflects from objects in the local area multipath environment.

2. A diversity antenna structure in accordance of with claim 1, further comprising:

an outer surface with areas of metalization defining the antenna elements; and an inner surface with areas of metalization defining a ground plane.

3. A diversity antenna structure in accordance with claim 1, further comprising:

active circuitry attached to an inner surface of the dome.

4. A diversity antenna structure in accordance with claim 1, wherein the dome comprises a polyhedron dome.

5. A diversity antenna structure in accordance with claim 1, wherein the dome comprises a hemispherical dome.

6. A diversity antenna structure in accordance with claim 1, wherein the plurality of facets comprises six facets.

7. A diversity antenna structure in accordance with claim 1, wherein the dome comprises metalized plastic.

8. A diversity antenna structure in accordance with claim 1, wherein the antenna elements comprise half-wave patch antennas.

9. A diversity antenna structure in accordance with claim 1, wherein the antenna elements comprise quarter-wave patch antennas.

10. An antenna structure, comprising:

a dome having at least two non-coplanar, positionally non-adjustable facets;

at least two but not more than six antenna elements attached to the dome with the antenna elements being arranged and configured so that the antenna elements together provide substantially full coverage over a hemispherical region, wherein each facet has located thereon one of the antenna elements; and active circuitry attached to a first inner surface of the dome and coupled to the antenna elements;

wherein the at least two but not more than six antenna elements are configured to achieve diversity in a local area multipath environment that is created when a signal reflects from objects in the local area multipath environment.

11. An antenna structure in accordance with claim 10, wherein the dome comprises an outer surface and the antenna elements comprise areas of metalization on the outer surface.

12. An antenna structure in accordance with claim 10, wherein the dome comprises a second inner surface and the antenna structure further comprises areas of metalization on the second inner surface defining a ground plane.

13. An antenna structure in accordance with claim 10, wherein the at least two non-coplanar facets comprises six facets.

14. An antenna structure in accordance with claim 10, wherein the dome having at least two non-coplanar facets comprises a polyhedron dome having six facets.

15. An antenna structure in accordance with claim 10, wherein the dome comprises metalized plastic.

16. An antenna structure in accordance with claim 10, wherein the active circuitry is coupled to the antenna elements with a coplanar feed structure.

17. An antenna structure in accordance with claim 10, wherein the active circuitry is coupled to the antenna elements with a microstrip feed structure.

18. An antenna structure in accordance with claim 10, wherein the antenna elements comprise half-wave patch antennas.

19. An antenna structure in accordance with claim 10, wherein the antenna elements comprise quarter-wave patch antennas.

20. A method of making an antenna structure, comprising the steps of:

forming a dome having a plurality of positionally non-adjustable facets;

mounting at least two but not more than six antenna elements on the dome;

arranging and configuring the at least two but not more than six antenna elements so that the antenna elements together provide substantially full coverage over a hemispherical region;

attaching active circuitry to a first inner surface of the dome;

coupling the active circuitry to the antenna elements; and configuring the antenna elements to achieve diversity in a local area multipath environment that is created when a signal reflects from objects in the local area multipath environment.

21. A method in accordance with claim 20, wherein the step of mounting at least two but not more than six antenna elements on the dome comprises the step of:

forming areas of metalization on an outer surface of the dome.

22. A method in accordance with claim 20, wherein the step of forming a dome comprises the step of:

forming the dome so that it comprises a polyhedron dome having six facets.

23. A method in accordance with claim 20, wherein the step of forming a dome comprises the step of:

forming the dome from metalized plastic.

24. A method in accordance with claim 20, wherein the step of coupling the active circuitry to the antenna elements comprises the step of:

coupling the active circuitry to the antenna elements with a coplanar feed structure.

25. A method in accordance with claim 20, wherein the step of coupling the active circuitry to the antenna elements comprises the step of:

coupling the active circuitry to the antenna elements with a microstrip feed structure.

26. A method in accordance with claim 20, wherein the antenna elements comprise half-wave patch antennas.

27. A method in accordance with claim 20, wherein the antenna elements comprise quarter-wave patch antennas.

28. A method of receiving a signal in a multi-path environment, comprising the steps of:

establishing a dome having a plurality of positionally non-adjustable facets and at least two but not more than six antenna elements attached to the dome with the antenna elements being arranged and configured so that the antenna elements together provide substantially full coverage over a hemispherical region;

placing the dome in the multi-path environment;

receiving the signal from a first direction in the multi-path environment with a first of the at least two but not more than six antenna elements located on one of the facets of the dome; and receiving the signal from a second direction in the multi-path environment with a second of the at least two but not more than six antenna elements located on another of the facets of the dome;

wherein the multipath environment comprises a local area multipath environment that is created when the signal reflects from objects in the local area multipath environment;

wherein the at least two but not more than six antenna elements are configured to achieve diversity in the local area multipath environment.

29. A method in accordance with claim 28, further comprising the step of:

propagating the signal from at least one of the first and second antenna elements along a conductor formed on a surface of the dome.

30. A method in accordance with claim 28, further comprising the step of:

processing the signal with active circuitry attached to an inner surface of the dome.

31. A method in accordance with claim 28, wherein the dome comprises a polyhedron dome.

32. A method in accordance with claim 28, wherein the dome comprises a hemispherical dome.

33. A method of transmitting a signal in a multi-path environment, comprising the steps of:

establishing a dome having a plurality of positionally non-adjustable facets and at least two but not more than six antenna elements attached to the dome with the antenna elements being arranged and configured so that the antenna elements together provide substantially full coverage over a hemispherical region;

placing the dome in the multi-path environment;

transmitting the signal along a first direction in the multi-path environment with a first of the at least two but not more than six antenna elements located on one of the facets of the dome; and transmitting the signal along a second direction in the multi-path environment with a second of the at least two but not more than six antenna elements located on another of the facets of the dome;

wherein the multipath environment comprises a local area multipath environment that is created when the signal reflects from objects in the local area multipath environment;

wherein the at least two but not more than six antenna elements are configured to achieve diversity in the local area multipath environment.

34. A method in accordance with claim 33, further comprising the step of:

propagating the signal to the first and second antenna elements along one or more conductors formed on a surface of the dome.

35. A method in accordance with claim 33, further comprising the step of:

processing the signal with active circuitry attached to an inner surface of the dome.

36. A method in accordance with claim 33, wherein the dome comprises a polyhedron dome.

37. A method in accordance with claim 33, wherein the dome comprises a hemispherical dome.

* * * * *